US006945874B2

(12) United States Patent
Kelly

(10) Patent No.: US 6,945,874 B2
(45) Date of Patent: Sep. 20, 2005

(54) GRIPPING DEVICE

(76) Inventor: Mary Jane Kelly, 6001 James St., Tinley Park, IL (US) 60477

( * ) Notice: Subject to any disclaimer, the term of this patent is extended or adjusted under 35 U.S.C. 154(b) by 146 days.

(21) Appl. No.: 10/726,855

(22) Filed: Dec. 3, 2003

(65) Prior Publication Data

US 2005/0124428 A1 Jun. 9, 2005

(51) Int. Cl.[7] ..... A63B 69/36
(52) U.S. Cl. ..... 473/201; 473/206
(58) Field of Search ..... 473/201, 202, 473/203, 204, 205, 206, 219, 226, 551

(56) References Cited

U.S. PATENT DOCUMENTS 2,928,678 A * 3/1960 Cutting ..... 473/206
3,227,455 A * 1/1966 Hulsman ..... 473/206
3,806,130 A * 4/1974 Jacques ..... 473/206
3,868,110 A * 2/1975 Jones ..... 473/551
4,226,418 A * 10/1980 Balfour ..... 473/551
4,613,156 A * 9/1986 Lajos ..... 280/821
D356,135 S 3/1995 Slusher
5,704,845 A * 1/1998 Boyte ..... 473/205
D445,158 S 7/2001 Stinson
6,350,206 B1 2/2002 Lambert, ll
6,540,621 B1 4/2003 Robinson
6,648,770 B1 11/2003 Snyder
D491,999 S * 6/2004 Scott ..... D22/142

* cited by examiner

*Primary Examiner*—Gregory Vidovich
*Assistant Examiner*—Nini F. Legesse
(74) *Attorney, Agent, or Firm*—Brinks Hofer Gilson & Lione

(57) ABSTRACT

A gripping device for use with a hand of a user. The gripping device includes a body portion having a hollow interior portion adapted to be secured to a shaft. The gripping device also includes a thumb receiving member and a fingers receiving member connected to the body portion, the fingers receiving member generally opposite the thumb receiving member. The thumb receiving member and fingers receiving member allow the user to secure a hand to the shaft. The shaft is located on a golf club in one embodiment.

16 Claims, 5 Drawing Sheets

GRIPPING DEVICE

FIELD OF THE INVENTION

The field of the invention relates to gripping devices. More particularly, the invention relates to a gripping device for use on a sporting device such as a golf club.

BACKGROUND

Millions of people enjoy participating in sporting activities such as golf. In the United States alone, it has been estimated that over 25 million people consider themselves golfers, and over 36 million people played golf in 2001. The golf industry is a billion dollar industry having millions of enthusiasts.

Some people, however, have physical disabilities which prevent them from enjoying sports such as golf. Many people suffer from afflictions such as debilitating or degenerative muscle/tissue diseases, and neurological injuries such as brain injuries. It has been estimated that about 700,000 American have a stroke each year, and there are about 4.7 million stroke survivors alive today. These diseases and injuries can limit an individual's muscular and neurological function. For example, a stroke can lead to extremities that are weak or unable to function properly. Persons suffering from the muscular and neurological effects of these conditions are often unable to participate in sporting activities. Thus, a need exists for a device to help those people with muscular or neurological limitations to be able to participate in sporting activities.

BRIEF SUMMARY

The present invention is directed to a gripping device for use with a hand of a user. The gripping device includes a body portion having a hollow interior portion adapted to be secured to a shaft. The gripping device also includes a thumb receiving member and a fingers receiving member connected to the body portion, the fingers receiving member generally opposite the thumb receiving member. The thumb receiving member and fingers receiving member allow the user to secure a hand to the shaft. The shaft is located on a golf club in one embodiment.

The present invention is also directed to a method of enhancing the grip of a user on a sporting element. The method includes providing a gripping device including a body portion having a hollow interior portion. The gripping device also includes a thumb receiving member and a fingers receiving member connected to the body portion, the fingers receiving member generally opposite the thumb receiving member. The method also includes attaching the body portion of the gripping device to a sporting element, inserting the thumb of a user into the thumb receiving member, and inserting a finger of a user into the fingers receiving member.

Therefore, the present invention allows those who have suffered muscle or nerve injuries which limit the muscular control in the extremities to participate in sporting activities. The present invention includes a gripping device that allows a user to secure a hand to a sporting element such as a golf club.

DETAILED DESCRIPTION OF THE DRAWINGS AND THE PRESENTLY PREFERRED EMBODIMENTS

Figure 1:
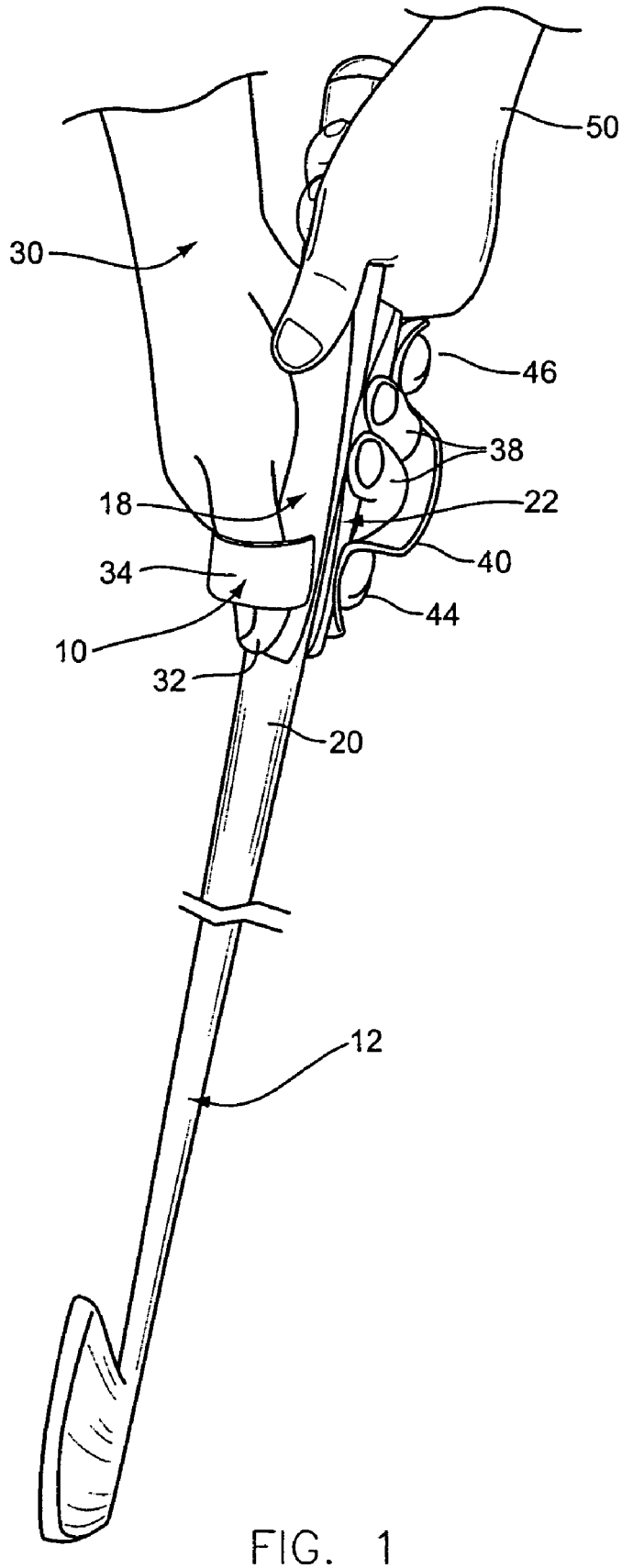
FIG. 1 illustrates a perspective view of an embodiment of a gripping device of the present invention on a golf club.

FIG. 1 shows an embodiment of the gripping device 10 of the present invention affixed to a golf club 12. Although the gripping device 10 of the present invention is shown being used with a golf club 12, it will be apparent to those skilled in the art that the present invention could be used with other similar sporting devices, including baseball bats, croquet mallets, pool cues, and tennis racquets. The use of the gripping device with other sporting elements such as ski poles is intended to be encompassed within the scope of the present invention. Further, the gripping device of the present invention could be implemented with devices that need to be gripped other than sporting elements such as cooking utensils, gardening elements such as a hose or beauty products such as hair brushes.

The gripping device 10 includes a body portion 18 that is attached to the golf club 12 by inserting a shaft portion 20 or club handle through a longitudinal opening 22 in the body portion 18. The body portion 18 securely attaches to the shaft portion 20, allowing a user to grasp the gripping device 10 by placing a right hand 30 around the body portion 18 and inserting a thumb 32 into the thumb loop 34 and middle fingers 38 into the fingers loop 40. In this embodiment, the index finger 44 and little finger 46 are located adjacent the fingers loop 40. The user's left hand 50 is positioned above the right hand 30. The gripping device 10 is adjustable to allow attachment at various locations along the shaft portion 20.

Figure 2:
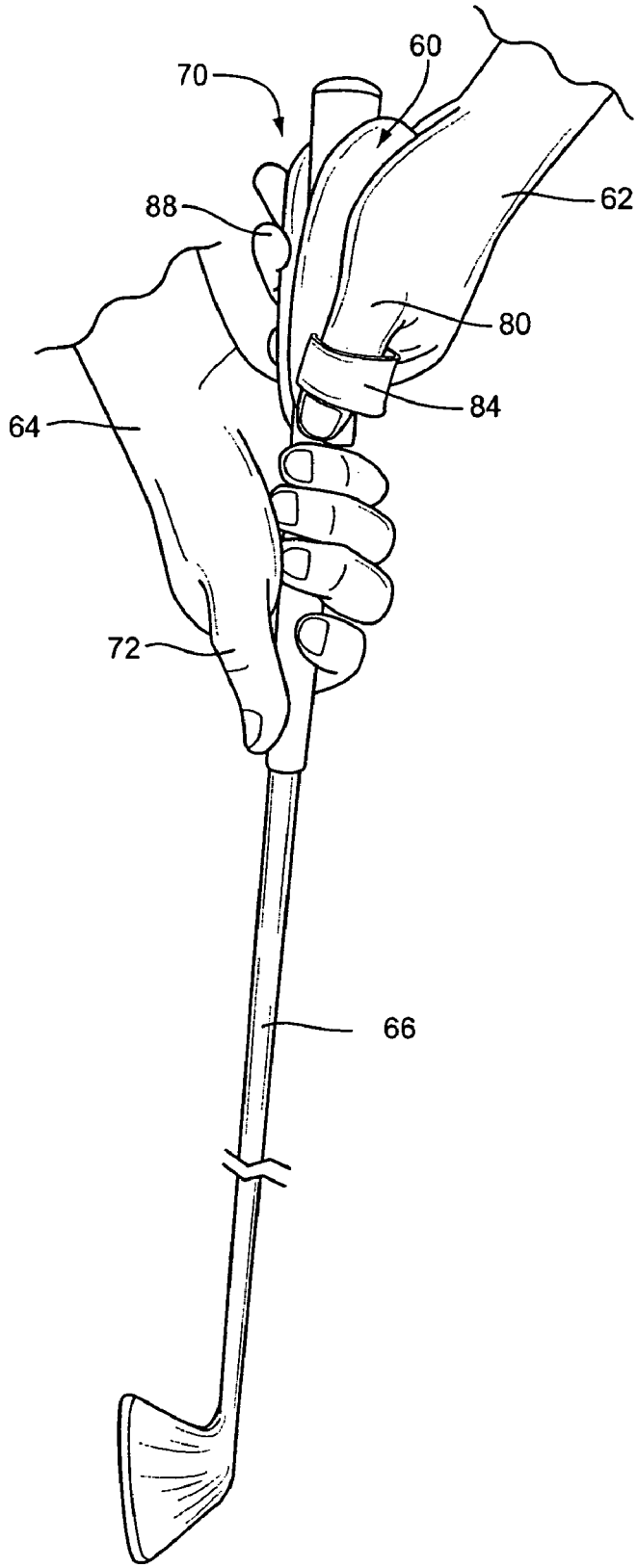
FIG. 2 illustrates a perspective view of a second embodiment of a gripping device of the present invention on a golf club.

The use of an alternate embodiment of the gripping device 60 is shown in FIG. 2. The gripping device 60 is essentially the same as the gripping device 10 except that it is designed for use with the left hand 62 of a user. The user's right hand 64 is placed on shaft 66 or the handle of the golf club 70, with the right thumb 72 along the shaft 66, in a standard club grip. The gripping device 60 is placed around the shaft 66. The left thumb 80 of the user's left hand 62 is placed in the thumb loop 84. The fingers 88 of the user's left hand 62 are positioned in the fingers loop 90 (shown in FIG. 3). This allows a user with muscular or neurological injuries in the left hand to more easily and securely grip the golf club 70.

Figure 3:
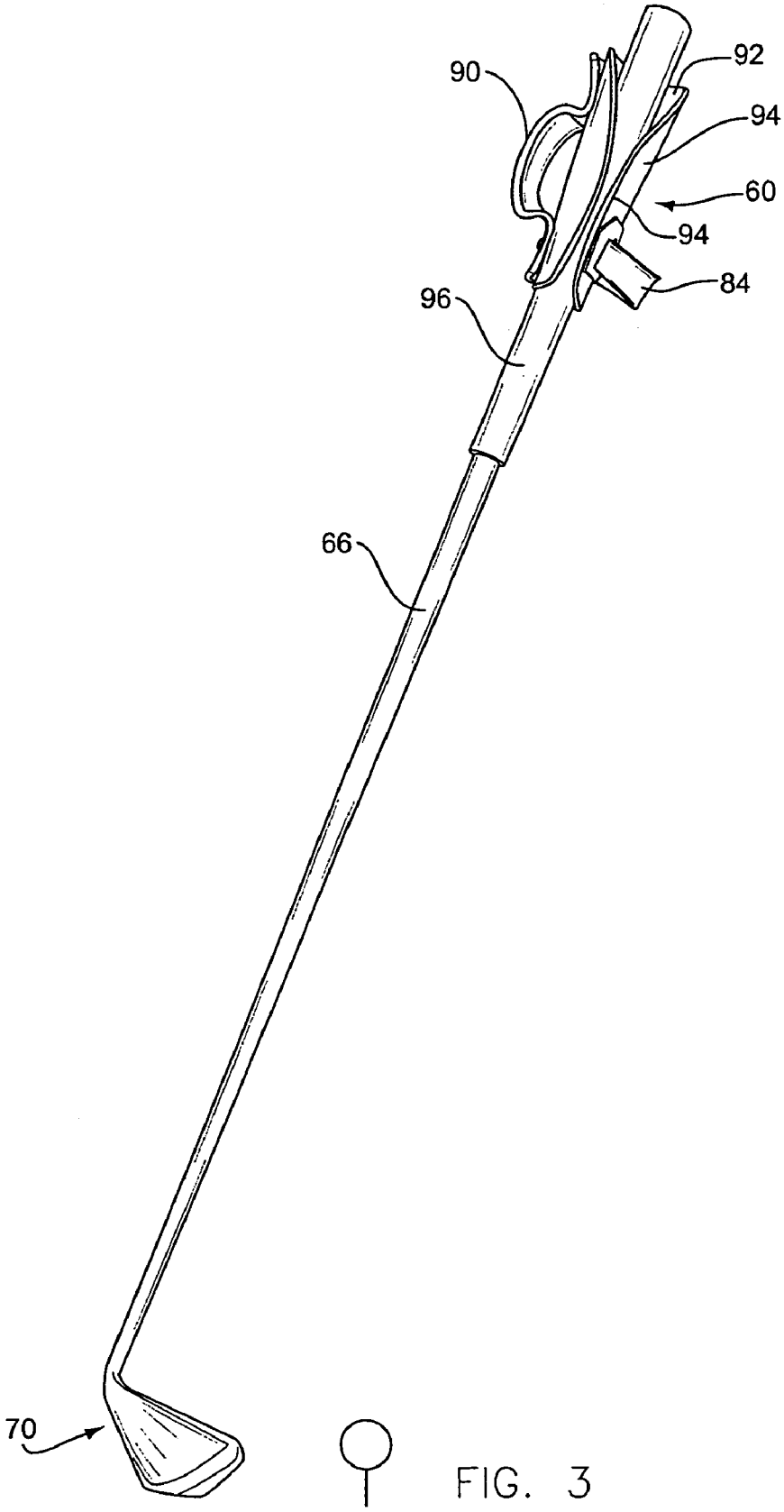
FIG. 3 illustrates a side view of the embodiment of the gripping device as shown in FIG. 2.

FIG. 3 further illustrates the use of the gripping device 60 with the hands of a user removed. This figure better illustrates the longitudinal opening 92 in the body portion 94. In this embodiment, the shaft 66 includes a handle portion 96 shown passing through the longitudinal opening 92. The longitudinal opening 92 is sized to securely mate with the handle portion 96/shaft 66 of an associated sporting element.

Figure 4:
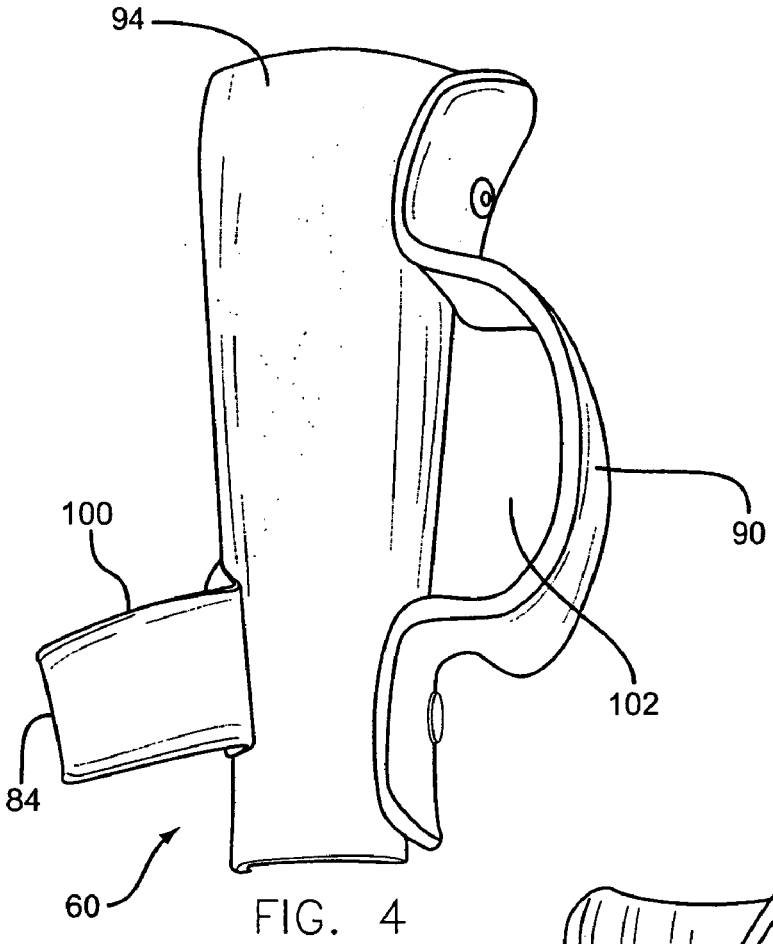
FIG. 4 shows a first side view of the embodiment of the gripping device of FIGS. 2–3 without a golf club being attached thereto.
Figure 5:
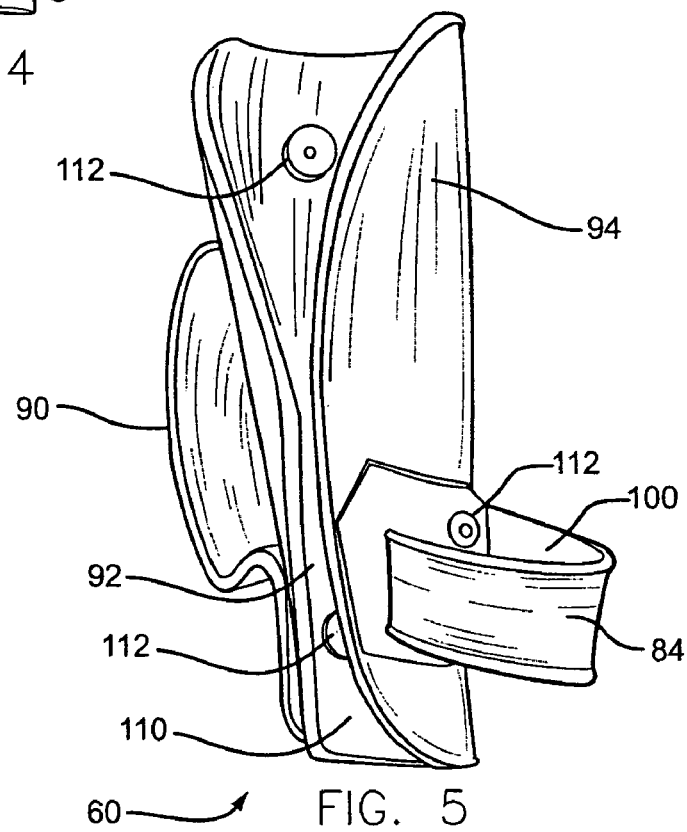
FIG. 5 shows a second side view of the embodiment of the gripping device of FIGS. 2–4 without a golf club being attached thereto.

FIGS. 4 and 5 illustrate the embodiment of the gripping device 60 of FIGS. 2 and 3 in greater detail. The gripping device 60 includes a body portion 94. Attached to the body portion 94 are the thumb loop 84 and the fingers loop 90. The thumb loop 84 extends laterally across the body portion 94 and defines a thumb opening 100. The thumb opening 100 is of sufficient size to accommodate a thumb of a user. The size of thumb opening 100 could be varied to accommodate different size thumbs, for example, adult and children sizes. The fingers loop 90 extends longitudinally along the body portion 94 and defines a fingers opening 102. The fingers opening 102 is sized, in this embodiment, to accommodate two fingers of a user. However, the fingers opening 102 may be altered in size to accommodate different finger sizes.

As shown in FIG. 5, the body portion 94 has a curved interior portion 104 which is adapted to fit around a sporting element such as a golf club. The body portion 94 also includes a longitudinal opening 106 which allows the body portion 94 to be placed around a sporting element. Fastening elements 112, such as the illustrated pop rivets, are used to secure the thumb loop 84 and the fingers loop 90 to the body portion 94. It should be recognized that alternative fastening elements such as adhesives or flat head nuts and bolts could also be used to secure the elements of the gripping device 60 together. Although FIGS. 4 and 5 show a "handed" version of the device, the scope of the present invention includes a mirror image version of the device for use with the opposite hand.

Figure 6:
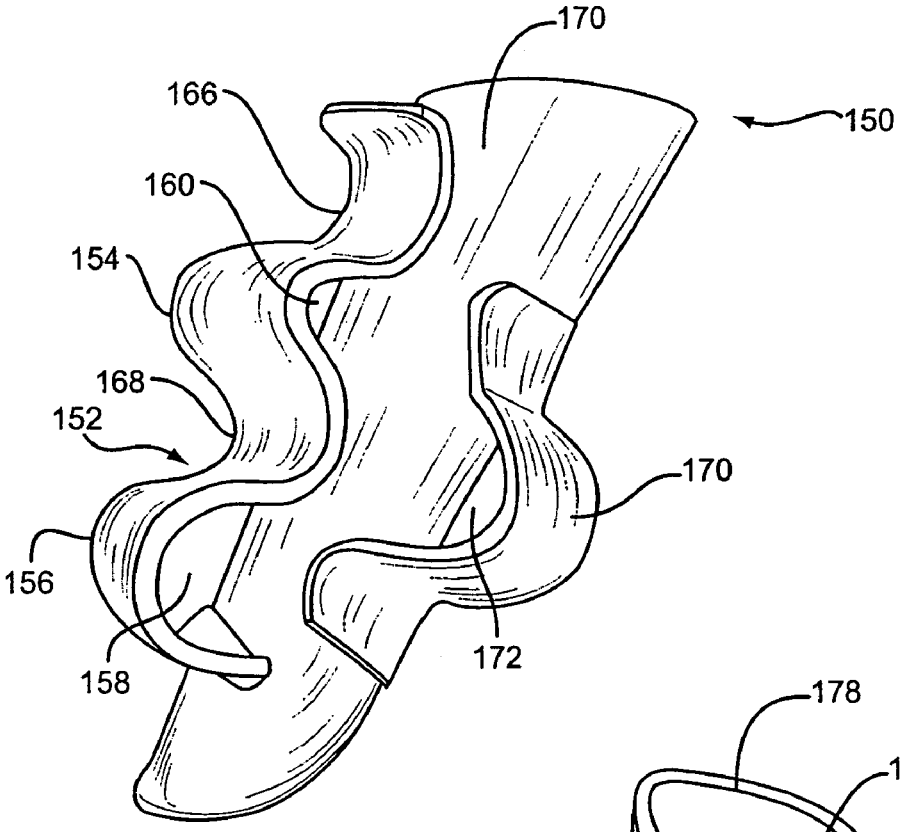
FIG. 6 shows a first side view of a third embodiment of a gripping device of the present invention without a golf club being attached thereto.
Figure 7:
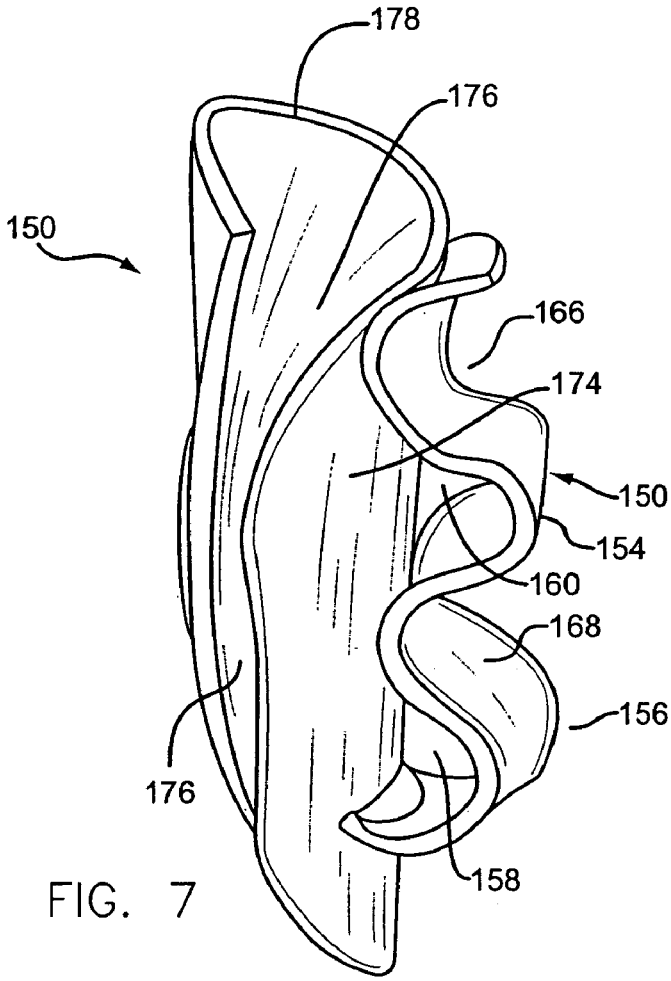
FIG. 7 shows a second side view of a third embodiment of a gripping device of the present invention without a golf club being attached thereto.

FIGS. 6 and 7 illustrate another embodiment of the gripping device 150 of the present invention. The gripping device 150 is essentially the same as the gripping devices 10 (FIG. 1) and 60 (FIGS. 2–5) except that the fingers receiving loop 152 has an alternate construction. The fingers receiving loop 152 includes two loops 154 and 156 that define two finger openings 158 and 160. The finger openings 158 and 160 are sized to accommodate the index finger and ring finger of a user. The remaining fingers are accommodated within the cavity portions 166 and 168. Thus, the fingers inserted into the two finger openings 158 and 160 are not adjacent fingers. The finger openings 158 and 160 can be sized to accommodate the fingers of a wide variety of users. A thumb loop 170 and thumb opening 172 is also illustrated. Turning to FIG. 7, the body portion 174 has a curved interior portion 176 which is adapted to fit around a shaft or handle of a sporting element such as a golf club. The body portion 174 also includes a longitudinal opening 178 which allows the body portion 174 to be placed around a sporting element. Although FIGS. 6 and 7 show a "handed" version of the device, the scope of the present invention includes a mirror image version of the device for use with the opposite hand.

The gripping devices 10, 60, 150 of the present invention are preferably flexible in order to be able to be placed around the sporting element, but sufficiently rigid in order to keep their shape. In one embodiment, the body portion of the gripping device is made from Ezeform® material or Aquaplast Resilient® material manufactured by Sammons Preston Rolyan. The Ezeform® material is preferred because it is relatively easily formed into the present invention. The thumb loop and fingers loops may be made from the same material. The gripping device of the present invention may also be made of other materials, including plastic, neoprene, and spandex fabric. Further, the thumb loop and fingers loop may be attached to the body portion by any known method, for example and without limitation, rivets, stitches, or adhesives.

The embodiments described above and shown herein are illustrative and not restrictive. The scope of the invention is indicated by the claims rather than by the foregoing description and attached drawings. The invention may be embodied in other specific forms without departing from the spirit of the invention. Accordingly, these and any other changes which come within the scope of the claims are intended to be embraced therein.

I claim:

1. A gripping device for use with a single hand of a user and a sporting element comprising:

a one-piece body portion having a generally funnel shaped hollow interior portion adapted to be secured to a shaft of the sporting element, the body portion having two spaced apart opposing side walls; wherein the body portion is substantially c-shaped;

a thumb receiving member connected to the body portion having a thumb opening;

a fingers receiving member connected to the body portion having a fingers opening, the fingers opening extending generally perpendicular to the thumb opening whereby the user could secure a hand to the shaft of the sporting element.

2. The device of claim 1 wherein the body portion that is adapted to be secured to the sporting element is a golf club.

3. The device of claim 1 wherein the body portion is flexible.

4. The device of claim 3 wherein the fingers receiving member defines a fingers receiving loop extending longitudinally along the body portion.

5. The device of claim 3 wherein the body portion includes a longitudinally extending opening.

6. The device of claim 5 wherein the thumb receiving member defines a thumb receiving loop extending laterally across the body portion.

7. The device of claim 5 wherein the fingers receiving member is adapted to extend over and secure two fingers of a user within the fingers opening.

8. The device of claim 7 wherein the fingers receiving member is adapted to extend over and secure two fingers that are not adjacent.

9. The device of claim 7 wherein the fingers receiving member is adapted to extend over and secure two adjacent fingers.

10. A gripping device for use with a single hand of a user comprising:

a generally flexible one-piece body portion having a generally funnel shaped longitudinally extending opening and a hollow interior portion, the body portion having two spaced apart opposing side walls; wherein the body portion is substantially c-shaped;

a laterally extending thumb receiving member connected to the body portion and adapted to extend over and across the thumb of a user;

a longitudinally extending fingers receiving member connected to the body portion, the fingers receiving member generally opposite the thumb receiving portion and adapted to extend over and across the fingers of a user.

11. The device of claim 10 wherein the fingers receiving member is adapted to extend over and secure two fingers of a user.

12. The device of claim 11 wherein the fingers receiving member is adapted to extend over and secure two adjacent fingers.

13. The device of claim 11 wherein the fingers receiving member is adapted to extend over and secure two fingers that are not adjacent.

14. A method of enhancing the grip of a single hand of a user on a sporting element comprising:

providing a gripping device comprising:

a funnel shaped one-piece body portion having a hollow interior portion, the body portion having two spaced apart opposing side walls; wherein the body portion is substantially c-shaped;

a thumb receiving member connected to the body portion;

a fingers receiving member connected to the body portion, the fingers receiving member generally opposite the thumb receiving member and extending generally perpendicular thereto;

attaching the body portion of the gripping device to a sporting element;

inserting the thumb of a user into the thumb receiving member; and inserting two or more fingers of a user into the fingers receiving member.

15. The method of claim 14 wherein the body portion is flexible and has a longitudinally extending opening, and wherein the body portion of the gripping device is attached to the sporting element by inserting the sporting element through the longitudinally extending opening, such that the hollow interior portion is around the sporting element.

16. The method of claim 14 wherein the body portion of the gripping device is attached to a golf club.

* * * * *